US005490290A

United States Patent [19]

Gold

[11] Patent Number: 5,490,290

[45] Date of Patent: Feb. 13, 1996

[54] OPEN FINGERED GLOVE STRUCTURE

[76] Inventor: Danny Gold, 27 Barker Road, Apt. E-2, Hong Kong, Hong Kong

[21] Appl. No.: 388,692

[22] Filed: Feb. 15, 1995

[51] Int. Cl.[6] ..... A41D 19/00

[52] U.S. Cl. ..... 2/159

[58] Field of Search ..... 2/159, 163, 161.1

[56] References Cited

U.S. PATENT DOCUMENTS

| | | | |
|---|---|---|---|
| 1,486,006 | 3/1924 | Blom | 2/163 X |
| 2,309,516 | 1/1943 | Lindfelt | 2/159 |
| 2,719,980 | 10/1955 | Haupt et al. | 2/159 |
| 3,262,126 | 7/1966 | Price | 2/159 |
| 4,748,693 | 6/1988 | Shinn | 2/163 X |
| 4,843,651 | 7/1989 | Gramza et al. | 2/161.1 |
| 5,295,269 | 3/1994 | Ballard | 2/161.1 X |

FOREIGN PATENT DOCUMENTS

| | | | |
|---|---|---|---|
| 631437 | 3/1927 | France | 2/159 |

*Primary Examiner*—Jeanette E. Chapman
*Assistant Examiner*—Shirra L. Jenkins
*Attorney, Agent, or Firm*—Aufrichtig Stein & Aufrichtig

[57] ABSTRACT

An improved design for an open fingered glove is disclosed. The traditional mechanism of attachment of the palm piece to the back piece through the use of fourchettes is eliminated and, instead, the stability of the attachment of the glove parts is provided by a by the use of connector strips made from lycra, leather or other traditional materials. The connector strips connect the sides of each finger from the palm part to the back part at a location proximate the tip of each finger and running to a point short of the crotch of each finger. Using such a construction, structural integrity may be maintained while permitting an opening to exist at the crotch of each finger, thereby providing for increased cooling of the hand.

7 Claims, 4 Drawing Sheets

OPEN FINGERED GLOVE STRUCTURE

BACKGROUND OF THE INVENTION

This invention relates, in general, to the field of glove design and, more particularly, to an improved design for an open fingered glove structure, where the traditional attachment of the palm piece to the back piece through the use of fourchettes is eliminated and, instead, the stability of the attachment of the glove parts is provided by the use of strips of a stretchable elastic fabric, such as spandex, sold under the trademark LYCRA, leather or other traditional materials. Using such a construction, structural integrity may be maintained while permitting an opening to exist at the crotch and inside of each finger, thereby providing for increased cooling of the hand.

In the field of wearing apparel, gloves have been developed in many styles for use in a variety of applications, while being manufactured using an assortment of construction techniques. Traditionally, gloves have been used to protect the hands of the wearer. Certain kinds of gloves have been designed for protection from the elements, while other gloves have been designed primarily as decorative elements, and have been worn mainly for show. A whole class of specialized gloves have also been developed for use in certain types of sporting events. Many of these specialized gloves, such as those for bicycle riding, golf, tennis, racquetball and the like.

In general, a glove usually consists of a number of parts, including: a palm piece, a back piece and a thumb piece. In practice it is necessary to join, or otherwise seal, the parts around their circumference, including the parts which make up the sides of the hand as well as each of the fingers, in order to complete construction of the glove. However, since the human hand is not a regular shape, but rather, complex where fingers are wider and thicker at their base than near their tips and vary in geometry as the fingers and hand are flexed, it is important to cut the patterns and assemble the parts in such a way that the glove fits the hand properly whether released or clasped without being too loose at the fingertips or too tight in the crotch of the fingers.

To accomplish this, an number of techniques have been designed and implemented.

The first is a Two Piece Pattern Technique. Using this technique, the fingers of the glove are made exceptionally wide to provide sufficient volume at the base of the fingers. This method is frequently used in the manufacture of plastic protective gloves, waterproof inserts made from a material such as GORETEX®, and some cotton knitted gloves used for industrial purposes. This technique makes for unwieldy gloves which are not suitable for precision activities.

A second is the Fourchette Pattern Technique. Using this technique, the back and palm parts of the glove are coupled with three fourchettes, or 'forks', provided between the fingers to form the sides of fingers two and three, three and four and four and five). In addition, small pieces called Quirks are added in the crotch. This is a very expensive, time consuming and precise glove construction. It also requires a tight attention to the glove separation sewing assembly.

A third technique is the Gunn Cut Technique. Using this technique, either the back part or the palm part is cut using a normal pattern and the opposing part is cut with increased volume in the area of the fifth, or "baby" finger and second, or "index" finger, with the middle and fourth fingers making up a gunn section which is added.

A fourth technique is the Clute Pattern Technique. Using this technique, the parts which make up the finger portions of the back part of the glove are cut with an increased volume and then attached to the palm part.

In each of the above described construction techniques the fingers are attached to the palm and back parts across the tips of the fingers, down the side of each finger (as well as along the outer edge of the thumb and baby finger, and down through the crotch between each of the fingers. A modification to this attachment construction sometimes occurs when the fourchette pattern technique is used. According to this modification an extra wedge, or diamond shaped piece of material, called a QUIRK , is inserted into the crotch on the back of the fourchette between second and third, third and fourth, and fourth and fifth fingers. This additional material adds to the dimension of the fingers and provides a better fit according to the shape of the wedge that lies at the base of the fingers between the palm and the back.

Unfortunately, while this technique works well in the manufacture and construction of fine dress gloves, it is not often suitable for the manufacture of other types of gloves. In particular, in the development of gloves used in sports, such as golf gloves, which have traditionally been manufactured on dress glove patterns, since the cutting and incorporation of the quirk is expensive and time consuming, as well as making the assembly of the glove parts more difficult, it has usually been eliminated. This results in the base of the fourchette being left open and the crotch at the back of the hand remaining unattached to the glove, reducing stability. On the other hand, if, in a sporting glove, the quirk is used, more exact measurements must be made during cutting and assembly and additional fine stitching within the crotch of the glove, reducing the efficiency of glove manufacture and increasing cost.

Accordingly, it has been determined that a need exists for an improved open fingered glove design permitting connection between the palm and back parts of a glove without the use of fourchettes and/or quirks, without the required special separation of the palm and back pieces, and which provides for structural stability ,while being simple and inexpensive to manufacture.

SUMMARY OF THE INVENTION

Generally speaking, in accordance with the invention, an improved open fingered glove design is provided. The open fingered glove design is especially adapted to be used in the development and manufacture of sporting gloves, such as off-trail cycling gloves and golf gloves. Using the glove structure of the invention, the traditional attachment of the palm part and the back part with fourchettes is replaced with stabilizing strips of material, such as LYCRA, leather or other traditional glove materials. By using the invention no material is required in the crotch of the fingers, allowing for air to flow between the fingers and providing improved cooling.

In particular, the invention eliminates the need for the use of quirks, or any material in the crotch area between the fingers, while maintaining structural stability. Under the construction in accordance with the invention the pattern size, contrary to each of the prior art techniques, is non-critical. In addition, even though the glove of the invention does not incorporate a fourchette, and even though the crotch area remains open, the finish and appearance of the glove is clean, while also being comfortable to wear.

Using the construction of the invention the back parts and the palm parts are attached with strips of material, such as lycra, along the sides of the fingers, connecting the back and palm portions from a distance approximately 1-2cm from the crotch to a point close to the tip of the finger. In one embodiment of the invention a single piece of LYCRA may be used to connect the back and palm portions of both sides of a finger, while in an alternate embodiment, separate pieces may be used to construct each side of each finger. Depending on the material used for manufacture, the glove may also incorporate piping around the back portion of the finger crotches, to provide additional support.

As noted above, under the invention a glove pattern structure is provided where the finger stalls are sewn in such a manner that the palm and back parts are not connected at the crotch of the fingers. This construction allows the glove pattern, or design, to be fabricated such that the relative distance from the crotch to the back of the glove and the palm of the glove may be different without affecting the fit of the glove. Normally, the 'drop', or distance from the contact point on the palm of the hand to the contact point on the back of the hand in the finger crotch area is about 2cm. In classic glove construction, it is critical to keep this spacing consistent because this small distance it is critical to preserve positioning during assembly. However, by using the design of the invention, pattern cutting and construction becomes far less critical. In particular, under the invention the tolerance permitted in the cutting of the palm part is 30mm, while in traditionally constructed gloves, tolerance is only about 12mm, almost a third.

In summary, then, according to the invention an innovative glove construction is provided with the back and palm parts connected in a novel manner. In accordance with the invention the back and palm fingers are continuous from the back and palm hand parts. Unlike the prior art fourchetted glove, where the back and palm portions are attached at the crotch of the fingers, under the invention in order to keep the back and palm parts integral, bands of connecting material are provided which can be positioned differentially relative to the palm and back parts, while eliminating the need for any material within the crotch area. This allows for innovative glove designs where the relative distance from the crotch of the fingers to the back part can be different than the same distance to the palm part, making the glove construction of the invention especially suited for the design of sports gloves. Finally, in accordance with the invention, the need for precision in cutting parts is reduced allowing for a finished product which is attractive to look at and comfortable to wear while providing protection to the wearer's hand.

Accordingly it is an object of the invention to provide an improved open fingered glove design which overcomes the limitations of the prior art.

It is another object of the invention to provide an improved open fingered glove design in which the traditional attachment of the palm and the back with fourchettes is replaced with strips of LYCRA leather or other material.

It is an additional object of the invention to provide an improved open fingered glove design in which the crotch area is left open to permit air to flow more freely to cool off the wearers hand.

It is a further object of the invention to provide an improved open fingered glove design in which the distance from the crotch area to the back part may be different than the distance from the crotch area to the palm part.

It is yet another object of the invention to provide an improved open fingered glove design in which the palm parts and back parts may be cut with a lesser degree of precision.

It is yet an additional object of the invention to provide an improved open fingered glove design which has improved structural strength without the use of quirks or fourchettes.

It is yet a further object of the invention to provide an improved open fingered glove design in which the open crotch area is cleanly finished.

It is still another object of the invention to provide an improved open fingered glove design which may be lightweight and heat venting for use in sports.

It is still an additional object of the invention to provide an improved open fingered glove design which is inexpensive to manufacture.

It is still a further object of the invention to provide an improved open fingered glove design which may be used in the construction of gloves which are designed to protect the wearer's hand more towards the fingertips than the palm of the hand.

Yet another object of the invention is to decrease the need to maintain a critical distance between the palm portion and back portion of the glove.

Yet a further object of the invention is to make improved linings for open fingered gloves such as bike gloves which do not require complete coverage of the wearer's hand, and particularly on the sides of the fingers and the crotches between the fingers.

Still a further object of the invention is to provide an improved glove suitable for use in warm environments or under active sports performance where heat dissipation is required.

Still other objects and advantages of the invention will, in part, be obvious and will, in part, be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
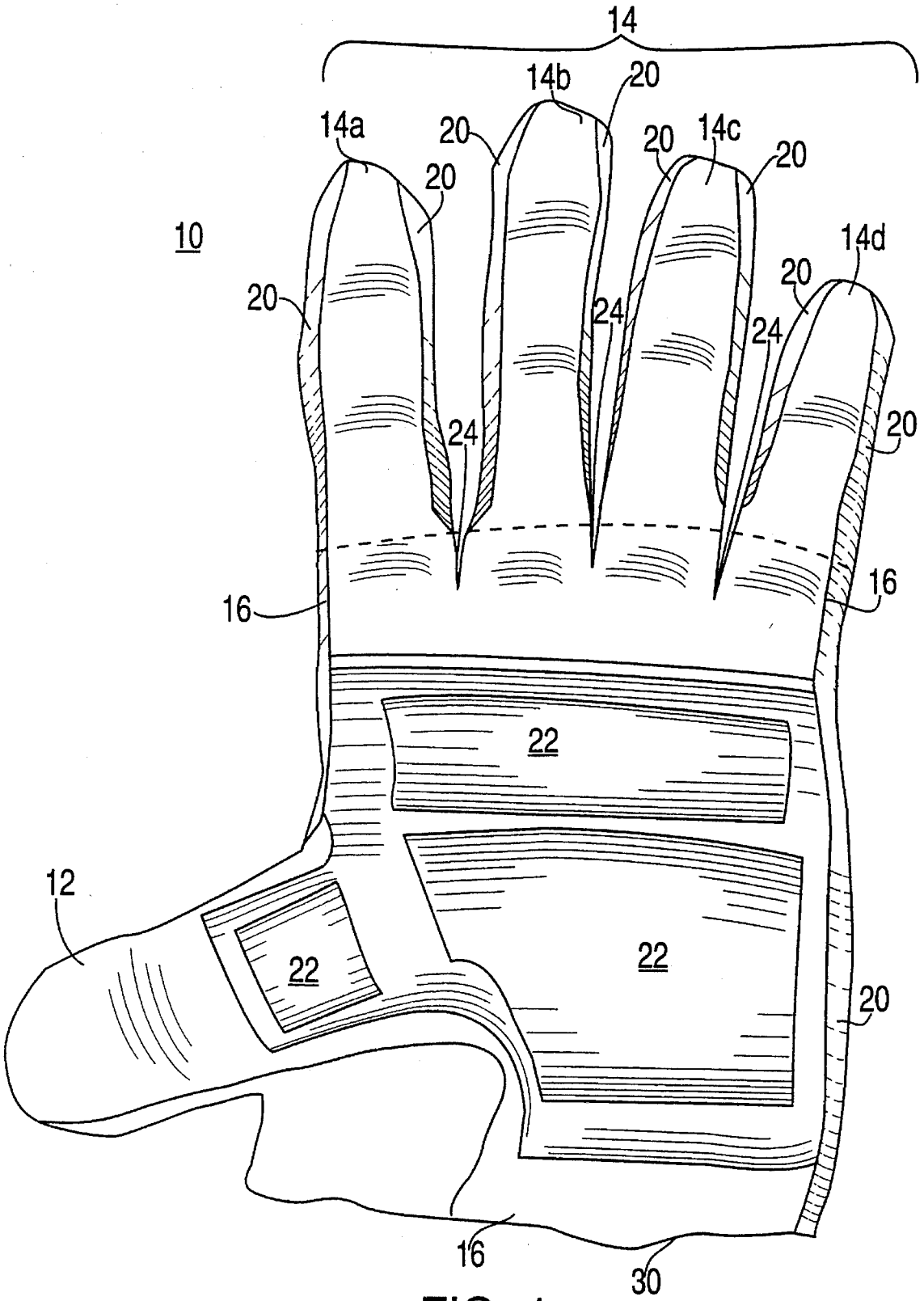
FIG. 1 is a perspective view showing the palm of an open fingered glove constructed in accordance with a preferred embodiment of the invention.

Referring first to FIG. 1, a plan view of a palm portion of an open fingered glove constructed in accordance with the invention is shown. The glove, generally in the shape of a human hand, is referred to as 10. The glove 10 is made up of a palm piece 16 and a back piece 18 (not shown in FIG. 1). Palm piece 16 of glove 10 comprises a thumb portion 12 and a finger portion 14, with each of the fingers being individually designated as 14*a* (the index finger), 14*b* (the middle finger), 14*c* (the ring finger), and 14*d* (the pinkie finger). A hand opening 30 is provided at the base of the glove to allow a wearer to insert his or her hand (not shown), fingers first, into the glove in order to put it on.

Although construction details may differ depending on the use for which the glove is designed, the glove illustrated in FIG. 1 is especially well adapted for use as an off-road cycling glove so that palm piece 16 further comprises a number of palm pads, 22 located at those points where a wearers hand might need the greatest protection from strain, vibration or abrasion.

Referring to the finger portion 14 of glove 10, the novel aspects of the open fingered designed can be easily seen. In particular, each finger is circumscribed by connector strip, 20, which is used to connect the palm piece 16 with the back piece 18. (This construction is shown in greater detail in FIG. 3). In the cycling glove illustrated palm piece 16 is made of leather while each of the connector strips 20 are made from LYCRA®. Lycra or another similar stretchable material is preferable in an application such as this since the LYCRA will stretch to accommodate a variety of hand and finger shapes, while contracting in size to take up any slack. It will also adapt as the wearer's hand is flexed or gripped. It is anticipated that other materials may be used for either the palm piece 16 or the connector strip 20, however, where the choice of materials will depend on considerations of cost and function.

As illustrated, while the connector strip 20 completely defines the outer sides of both the index finger 14*a* and the pinkie finger 14*d*, the inner sides of fingers 14*a* and 14*d*, as well as both sides of middle finger 14*b* and ring finger 14*c* are only partially connected to connector strips 20. In particular, as can be seen, each connector strip 20 extends from the tip of a finger (14*a* through 14*d*) to a point above the finger crotch area 24. This distance of separation may vary depending on the opening in the crotch area desired, but in the cycling glove shown, it is preferred that the connector strap 20 extend from the tip of each finger to terminate at a point approximately 1–2cm above the finger crotch 24. An alternative embodiment includes a connector strip 20 along the outer edge of index finger 14*a* and pinkie finger 14*d* terminating at a point which is at approximately the same height above finger crotch 24 as the inner connector strips. In such a case, additional flexibility and/or an increased flow of air could be provided to the index finger and the baby finger at the cost of slightly increasing the cost of construction. However, it is generally preferred that the outer perimeter of the glove be as smooth and continuous as possible in order to enhance wearer comfort and appearance.

Figure 2:
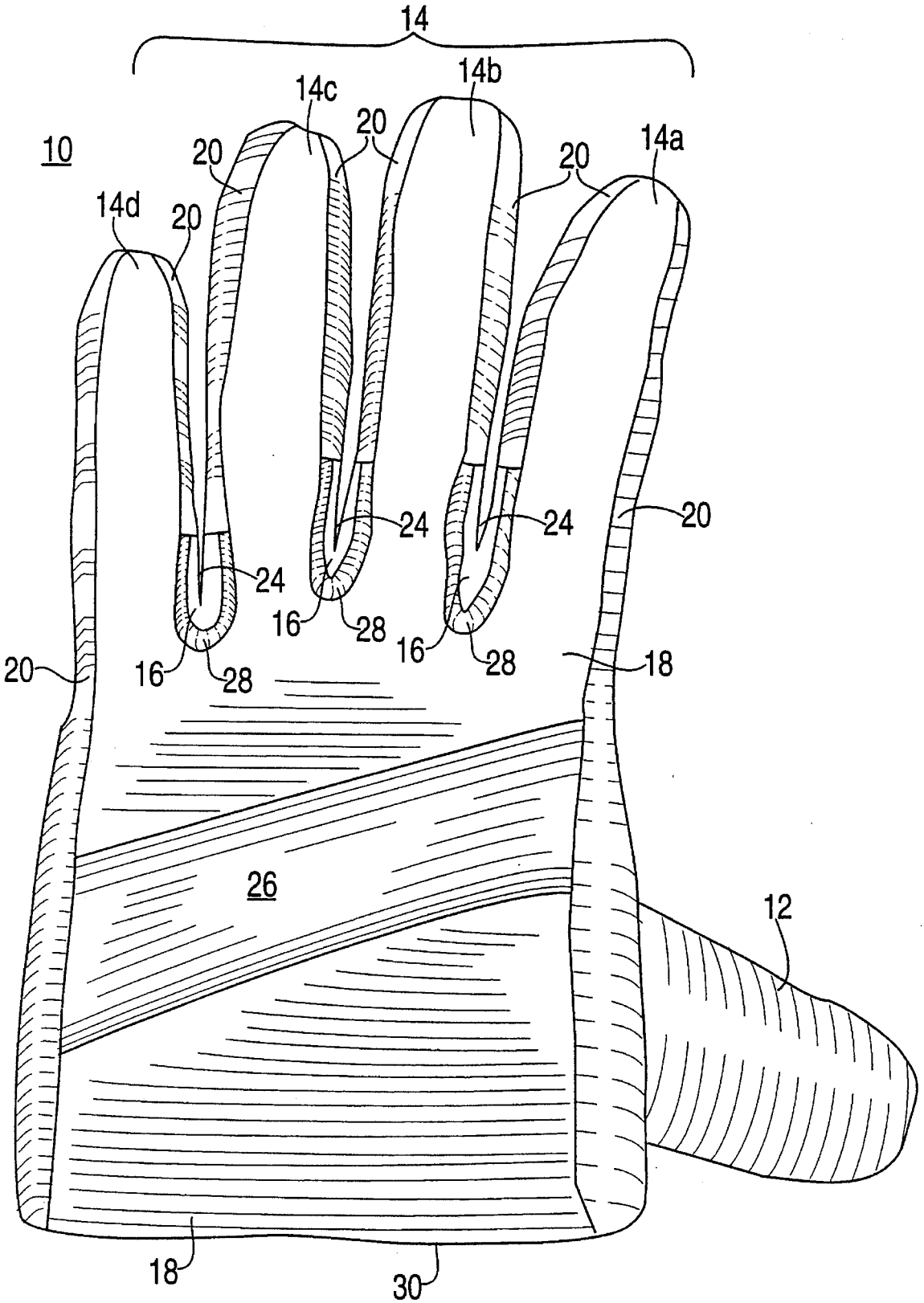
FIG. 2 is a perspective view showing the back of the open fingered glove construction of FIG. 1.

Turning, then, to FIG. 2 the back side of glove 10 is shown. Back piece 18 is cut roughly in the shape of a human hand and, in an embodiment especially adapted for use as an off-road cycling glove, may be made from a lightweight material such as GORETEX®, a breathable material which provides thermal insulation while being moisture permeable. The back piece 18 includes a back pad 26 which is constructed of leather and helps to protect the wearers knuckles.

As can be seen more clearly in FIG. 2, using the teaching of the invention the finger crotch area 24 is created with a differential construction between the palm and back pieces. In particular, the inside surface of each finger is constructed with a connector strip 20. This connector strip terminates before reaching the intersection of two fingers and an open space is defined. In a preferred embodiment this space is reinforced on the back piece through the use of a piping member 28, which extends from at least the point where one connector strip 20 ends and continues to the point where the adjacent connector strip 20 begins. In a preferred embodiment the piping member 28 is constructed from a reinforced, ribbed nylon ribbon which resists folding or pleating and which provides a finished appearance to the back of the glove.

The construction of glove 10 can be seen in FIG. 2 from an observation of the back piece 18. In particular, as illustrated, the cut of the finger crotch area differs between the palm piece 16 and the back piece 18. As shown, through the use of connector strips 20 a wide, open space may be defined on the back piece 18, while permitting a tighter coupling between fingers on the palm piece 16. This can be seen in FIG. 2 in that the inside of palm piece 16 may be seen through the space defined by piping members 28. Using this construction the glove 10 of the invention may deviate from the more traditional symmetrical connection of back and palm pieces, providing a highly protective, padded, leather palm surface while allowing the back of the glove to be manufactured in a highly flexible form, with extra space between fingers to permit additional finger mobility and enhanced hand cooling while enabling the use of GORE-TEX or other insulating/moisture permeable material to construct the back piece.

Figure 3:
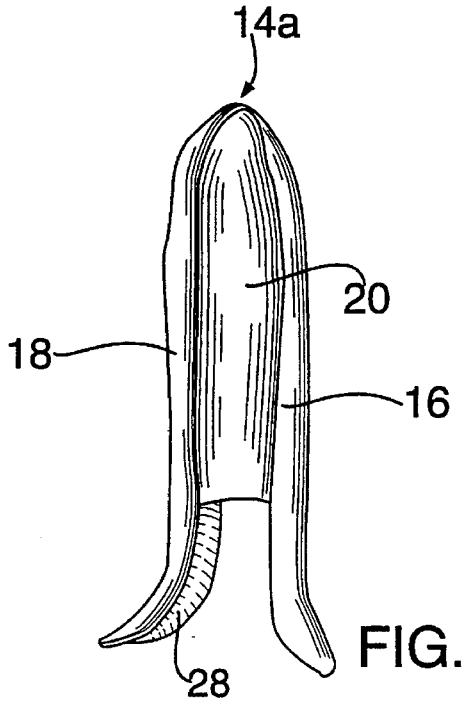
FIG. 3 is a cutaway side view of a single finger of the open fingered glove of FIG. 1.

Reference is next made to FIG. 3, like reference numerals corresponding to like elements, which illustrates a side view of finger 14*a* to more clearly illustrate the assembly of each of the elements of the improved open fingered glove design structure. As can be seen, the palm piece 16 is connected to the back piece 18 with a connector strip 20. In FIG. 3 it can be seen that the connector strip 20 does not extend to the bottom of the finger crotch, but terminates some distance higher, where piping 28 starts. In this preferred embodiment, piping 28 starts individually, where connector strip 20 terminates. Piping 28 may begin lower or even overlay a portion of connector strip.

Figure 4:
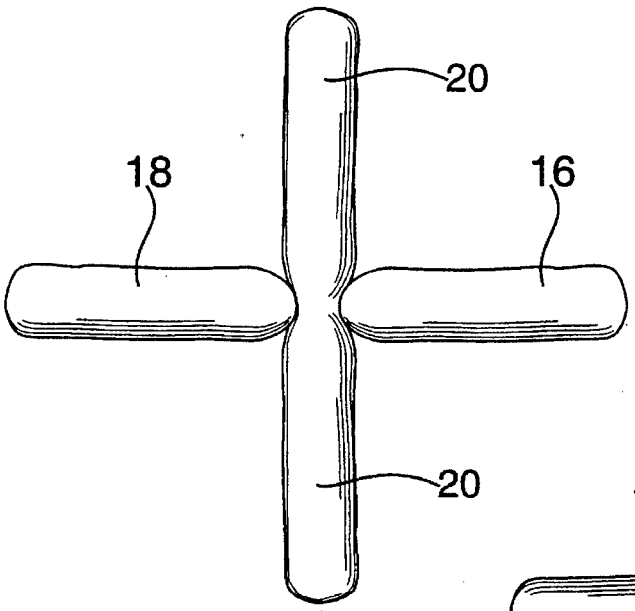
FIG. 4 is a cutaway top plan view of a glove constructed in accordance with a preferred embodiment of the invention illustrating the pre-assembly state of the finger tip shown in FIG. 3.

Reference is next made to FIG. 4 which illustrates the pre-assembly state of the tip of each finger in accordance with a preferred embodiment of the invention. As shown, the tip of each finger is constructed by joining back piece 18, palm piece 16 and connector strip 20. In FIG. 4 connector strip 20 is shown to be a single member circumscribing both sides of a single finger. In an alternate embodiment, shown in FIG. 5, connector strips 20 defining each side of a single finger are constructed from two separate elements.

Figure 5:
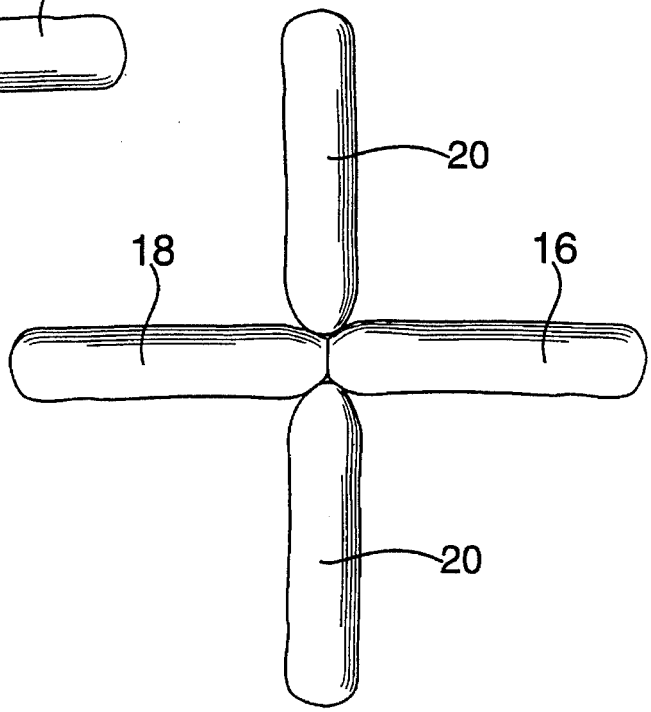
FIG. 5 is a cutaway top plan view of a glove constructed in accordance with a preferred embodiment of the invention illustrating the pre-assembly state of the finger tip shown in FIG. 3.
Figure 6:
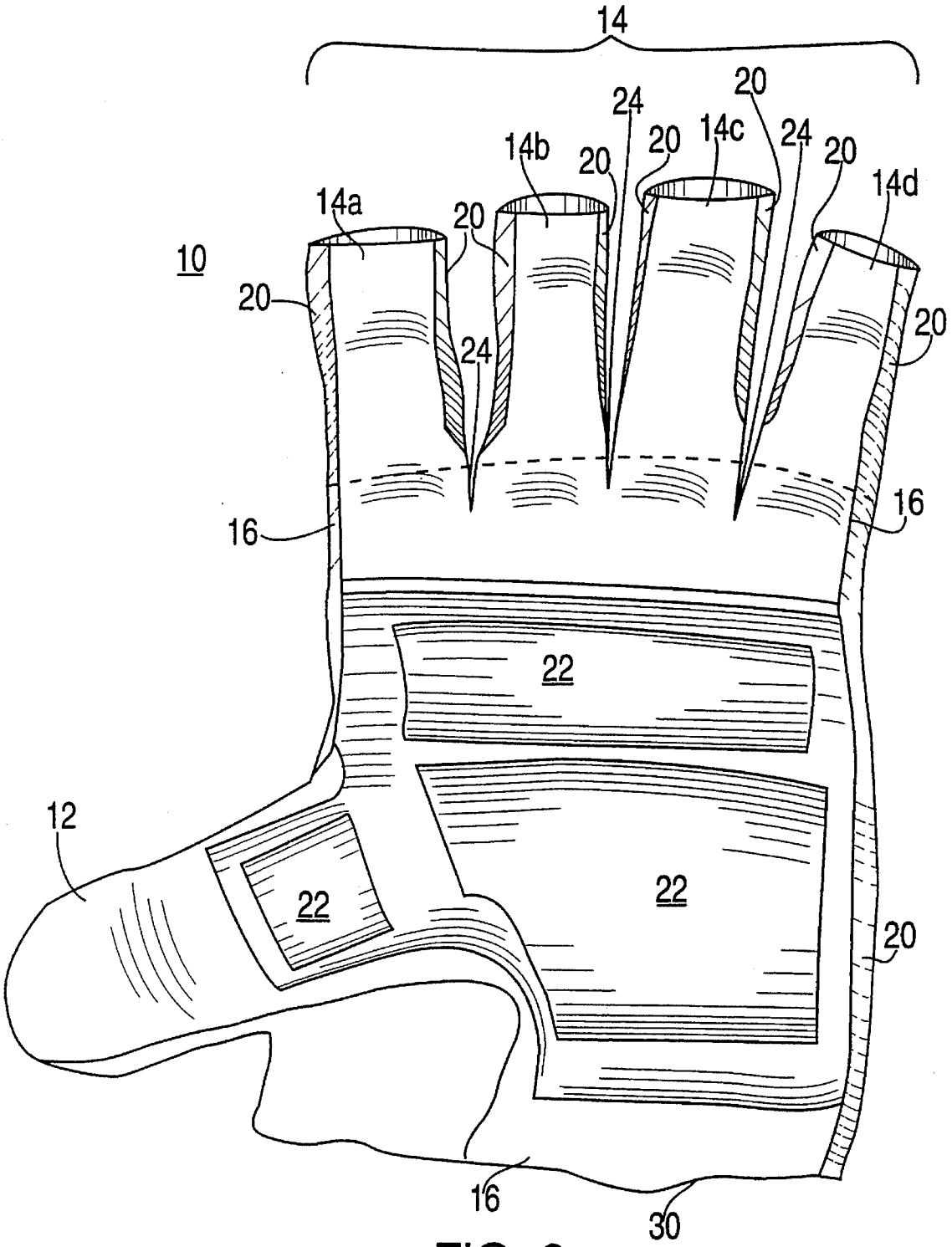
FIG. 6 is a perspective view showing the palm of an open fingered glove constructed in accordance with a preferred embodiment of the invention.

Reference is made to FIG. 6 where another embodiment of a glove with the open fingered glove design constructed in a fingerless design, where the fingertips are eliminated is depicted. In such a construction connector strip 20 will necessarily be established as a separate element on each side of each finger as shown in the construction of FIG. 5.

Therefore, by using the above described construction an open fingered glove design is provided in which glove back and palm parts are connected in a novel manner. Whereas the normal construction of a fourchetted glove is to attach the back and palm parts at the crotch of each finger and to maintain a strict dimensional relationship between the back and palm parts in accordance with the invention the finger crotch is permitted to remain open. Then, stretchable connector strips are used to continuously couple the back and palm parts of each finger. Because the crotch area is left open, the connection point of each finger may differ, allowing for increased flexibility in glove design. Further, by using the above described manner of construction, and by incorporating a connector strip manufactured from a stretchable material, such as LYCRA, the space between the palm part and the back part may be made greater, with the connector strip taking up any slack in the finger area, allowing for greater flexibility in glove construction in those applications, such as sports gloves, where more protection is required towards the tips of the fingers than provided in a traditional glove.

Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It will also be understood that the following claims are intended to cover all of the generic and specific features of the invention, herein described, and all statements of the scope of the invention which, as a matter of language, might be said to fall there between.

What is claimed is:

1. An improved open fingered glove comprising:

glove back means, formed generally in the shape of a human hand for forming at least a portion of the back of the glove;

glove palm means, formed generally in the shape of a human hand, for forming at least a portion of the palm of the glove; and thumb means, generally formed to cover a wearer's thumb;

said glove back means and said glove palm means to define a plurality of fingers, each of said fingers comprising an inner side defined as that side of the finger closest to said thumb piece an outer side defined as that side of the finger furthest away from said thumb piece, a tip defined as that area closest to the end of the finger and a crotch area defined as that area furthest away from the tip of the finger; and said improved open fingered glove further comprising connector means for connecting the fingers of said back piece to the fingers of said palm piece along at least one side of each finger and an outside of said crotch area leaving said crotch area open, said connector strips being located proximate to the tip of the finger to which it is attached and extending to a point outside the crotch area.

2. The improved open fingered glove, as claimed in claim 1, wherein the crotch area of each of the fingers of said back piece further comprises a reinforcing member, said reinforcing member circumscribing the crotch area between fingers on the back piece, said reinforcing member extending to the nearest termination point of the adjacent connector strip.

3. The improved open fingered glove, as claimed in claim 2, wherein said connector means are strips formed from a stretchable material.

4. The improved open fingered glove, as claimed in claim 3, wherein said stretchable material is spandex.

5. The improved open fingered glove, as claimed in claim wherein said reinforcing member is formed from a flexible nylon webbing.

6. The improved open fingered glove, as claimed in claim 1, wherein each of said connector strips extends across the tip of the finger to which it is attached to connect both sides of a finger to said palm part and said back part.

7. The improved open fingered glove, as claimed in claim 1, wherein the length of each of said fingers is shorter than the length of the fingers on the hand of a wearer and further where said connector strips do not connect the tips of the fingers of said palm part to the tips of the fingers of said back part.

* * * * *